United States Patent [19]

Knox et al.

[11] Patent Number: 5,067,910

[45] Date of Patent: Nov. 26, 1991

[54] SOLDERLESS ELECTRICAL CONNECTOR

[75] Inventors: George J. Knox; Daniel F. Cronch; Martin G. Afflerbaugh, all of Austin, Tex.

[73] Assignee: Minnesota Mining and Manufacturing Company, St. Paul, Minn.

[21] Appl. No.: 642,534

[22] Filed: Jan. 17, 1991

[51] Int. Cl.[5] ..... H01R 4/24

[52] U.S. Cl. ..... 439/402; 439/417

[58] Field of Search ..... 439/366, 367, 372, 402, 439/417, 418, 592, 598, 892, 893

[56] References Cited

U.S. PATENT DOCUMENTS

| | | | |
|---|---|---|---|
| 3,012,219 | 12/1961 | Levin et al. | 339/98 |
| 3,118,715 | 1/1964 | Potruch | 439/402 |
| 3,573,713 | 4/1971 | Enright et al. | 339/98 |
| 3,656,088 | 4/1972 | Seim | 339/98 |
| 3,718,888 | 2/1973 | Pasternak | 339/98 |
| 3,804,971 | 4/1974 | Bazille, Jr. | 174/88 |
| 3,892,460 | 7/1975 | Izraeli | 439/402 |
| 4,326,767 | 4/1982 | Silbernagel et al. | 339/98 |
| 4,444,448 | 4/1984 | Silbernagel et al. | 339/98 |
| 4,444,449 | 4/1984 | Aysta et al. | 339/99 |
| 4,496,206 | 1/1985 | Markwardt et al. | 339/98 |
| 4,820,191 | 4/1989 | Lacroix | 439/402 |
| 4,891,018 | 1/1990 | Afflerbaugh et al. | 439/402 |

*Primary Examiner*—Paula A. Bradley

*Attorney, Agent, or Firm*—Gary L. Griswold; Walter N. Kirn; John C. Barnes

[57] ABSTRACT

An electrical connector formed of a polyolefin is more compliant than the connectors formed of polycarbonate and therefor the cap and base are formed with interlocking wedging elements to resist separation of the cap from the base prior to closing the connector onto a plurality of wires for making a connection therebetween.

16 Claims, 3 Drawing Sheets

SOLDERLESS ELECTRICAL CONNECTOR

BACKGROUND OF THE INVENTION

1. Field of the Invention

The present invention relates to an improvement in solderless electrical connectors to afford the same greater integrity and in one aspect to the improved mechanical locking features for the cap to hold the same to the base member for shipping and handling prior to the making of a splice.

2. Description of the Prior Art

The present invention is directed at an improvement of the solderless connector described in U.S. Pat. No. 4,891,018. With the making of a new connector of a less rigid material like a polyolefin, attention was directed at making the connector hold together when connecting two or more wires with the same integrity as the older version of the connector which was made of a stiff polycarbonate material. The new material provided a connector which was more durable in splicing cables. However, with connectors made of the softer more pliable polyolefin material, problems were encountered in that the caps were not staying on the base when excessive force was applied to the cap after being assembled on the base member prior to forming a splice connection. Cap retention is a problem in the industry and attempts are made to retain the caps so they do not become dislodged from the base member under typical handling circumstances.

The present invention provides a solution to the problem of the caps becoming separated from the base members during normal handling situations.

The prior art is replete with patents utilizing the invention of the insulation displacing wire connection as disclosed in U.S. Pat. No, 3,012,219. The patent literature provides some patents concerned with cap retention on connector bodies. U.S. Pat. No. 3,804,971 illustrates a connector wherein the base member is provided with latching projections which interact with other latching projections on the cap to define the open and the closed positions. Other patents do show the use of ribs formed on the cap and body to retain the same in various latched positions, see U.S. Pat. Nos. 4,326,767 and 4,496,206. In each instance the ribs extend in a direction perpendicular to the direction of movement of the cap.

The present invention affords a solution to the problem without changing the size, shape or outside appearance of the connector product.

SUMMARY OF THE INVENTION

The present invention provides an improved wire connector for connecting a plurality of wires and comprises a base member having a plurality of side-by-side elongate wire-receiving channels having extended surfaces to support a corresponding plurality of wires. The base member is formed with parallel grooves which cross the extended surfaces, which grooves are generally perpendicular to the channels. The base member has wall members defining a generally truncated conical cavity about the extended surfaces, which wall members have inner and outer surfaces, and the axis of the wall members extends generally perpendicular to the axes of the wire receiving channels, with the walls of the cavity diverging from an opening into the cavity toward the surfaces. The wall members have circumferentially spaced radially directed wall portions positioned one pair adjacent each end of the pair of grooves. The wall portions provide wedge confining members which converge toward the opening of the cavity because of the conical shape of the wall members. A cap shaped to fit in the cavity includes an end wall and depending side walls having two legs extending beyond the free edges of the side walls at peripherally spaced locations and a wire connecting member is positioned between the legs and against the interior surface of the end wall. The legs are shaped to fit between the wall portions at the ends of the parallel grooves when the cap is placed on the base member with the dimension of the free edges of the depending side walls of the cap being slightly greater than the inside dimension of the opening in the base member. The legs are disposed inside the cavity and each leg is disposed between a pair of the wall portions at one end of the grooves. The legs have side edges which diverge toward the free edge of the legs to engage the wall portions, whereby the legs are wedged against said wall portions when a force tending to separate the cap from the base member is applied and, when force is applied against the end wall of the cap forcing it in a direction toward the extended surfaces, the opening in the flexible base member will be forced to expand allowing entry of the cap and connecting member into the cavity such that the connector affords fully effective spring reserve contact with the wires disposed in the channels.

The base and cap are formed of flexible polyolefin affording it to stretch slightly for receiving the cap in a locking position which will restrict its displacement under wire splicing conditions or when in closed position.

BRIEF DESCRIPTION OF THE DRAWING

The present invention will be further described with reference to the accompanying drawing, wherein.

DESCRIPTION OF THE PREFERRED EMBODIMENT

Figure 1:
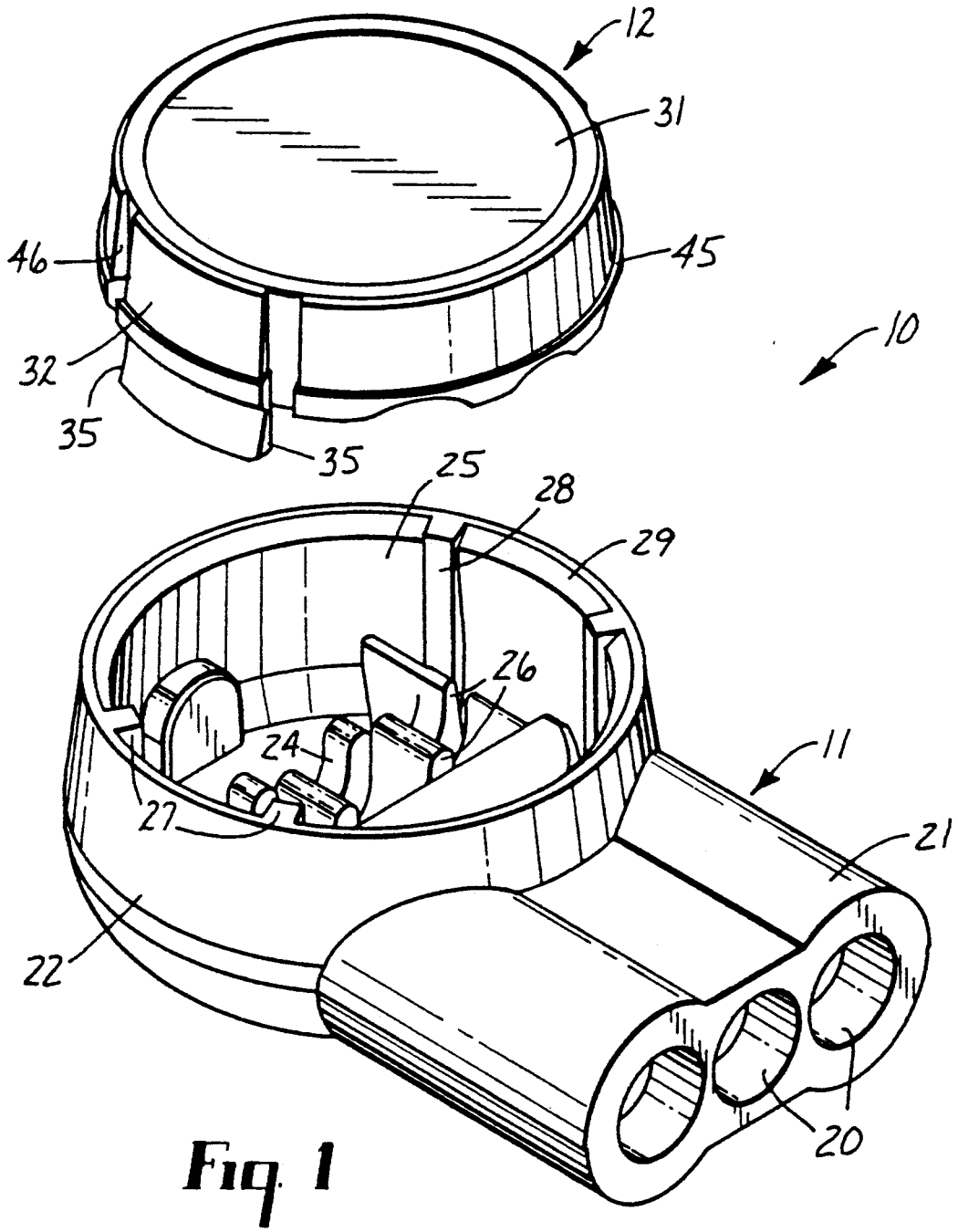
FIG. 1 is a perspective view of a connector according to the present invention shown in exploded view with the cap separated from the base member.

The present invention will be described with reference to the drawing wherein like reference numerals refer to like parts throughout the several views.

Figure 3:
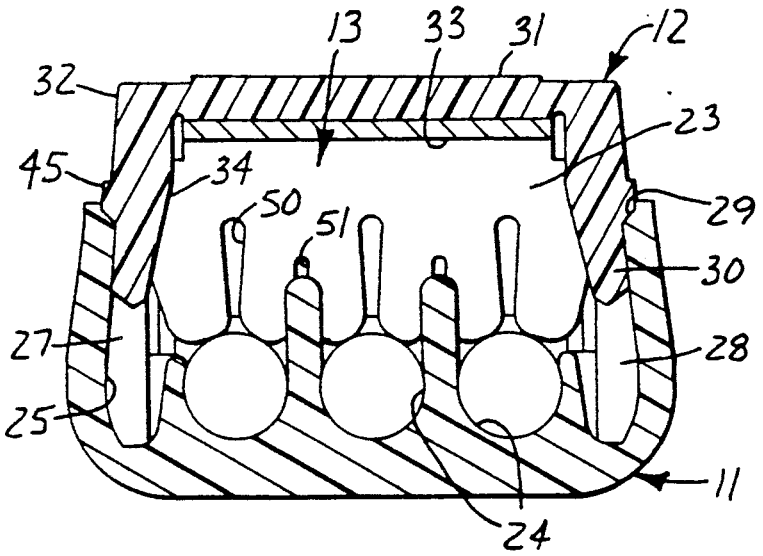
FIG. 3 is a transverse sectional view taken along line 3—3 of FIG. 2.

The connector 10 of FIG. 1 comprises an insulating base member 11 and an insulating cap 12. A generally U-shaped, conductive connecting member 13 (see FIG. 3) is supported by the cap 12 and affords good electrical contact with a plurality of wires which may be inserted in a multiple of longitudinal side-by-side tubular wire-receiving passages 20 for insertion of wire-ends to be connected. The passages 20 begin at an end of a throat portion 21 of the base 11 and extend into a body portion 22 where they provide wire supporting channels 24, see FIG. 3. The interior of the body portion 22 is formed with a cavity 25 communicating with the channels 24 and the base of this cavity 25 is deeply grooved across the channels 24 to provide slotted areas 26 to receive the legs 23 (only one of which is shown in FIG. 3) of the connecting member 13. The cavity 25 has a generally truncated conical shape and extends from an opening in the upper extended body portion 22 to the wire supporting channels 24 and is defined by interior wall surfaces which are disposed at an angle of between about 4° and 6° to the axis of the conical cavity. Two pair of radially extending circumferentially spaced wall portions 27 and 28 are formed on the interior of the wall members defining the cavity 25. The wall portions 27 and 28 converge toward the opening in the cavity and thus form a tapered recess the axis of which is generally parallel to the direction of movement of the cap when moving toward a closed wire connecting position. The wall members defining the cavity 25 are also formed with a support surface 29, surrounding the opening into the cavity 25, which supports the cap 12. As will be described later, the cap 12 has a pair of diametrically opposite legs 30 depending from the side walls thereof, which legs 30 extend into the cavity 25 and engage with the inner surfaces of the wall members defining the cavity 25 and the opposed sides of the wall portions 27 and 28. The surface 29 and the bottom surface of the cap 12 serve to cam the opening of the cavity 25 to an open position to accept the larger cap.

The base 11 is preferably molded of a flexible polymeric material which is preferably translucent, solvent resistant and hydrophobic and is resilient, i.e. it has good tensile strength and sufficient modulus of elasticity to afford 10 to 20% elongation. A preferred material with these properties is a polyolefin, for example polypropylene, which is less expensive than polycarbonate.

The cap 12 is the support for the metallic connecting member 13 and can also be formed of polypropylene. The cap 12 comprises an end or top wall 31 and generally conical, peripheral side walls 32. Extending from the free edges of the side walls 32, at opposed sides thereof, are the legs 30. The legs 30 are arcuate and are formed with inner projections 34 which fit between the legs or slotted plates 23 of the connecting member 13 which also has a bight portion 33 illustrated in FIG. 3. The projections 34 afford strength to the legs such that the outer surfaces retain a convex configuration. When the cap is in the open position the legs 30 cooperate with the inner surface of the cavity wall members and the opposed edges of the wall portions 27 and 28 respectively, to retain the cap in place and the connecting member in place for joining the wires.

Figure 4:
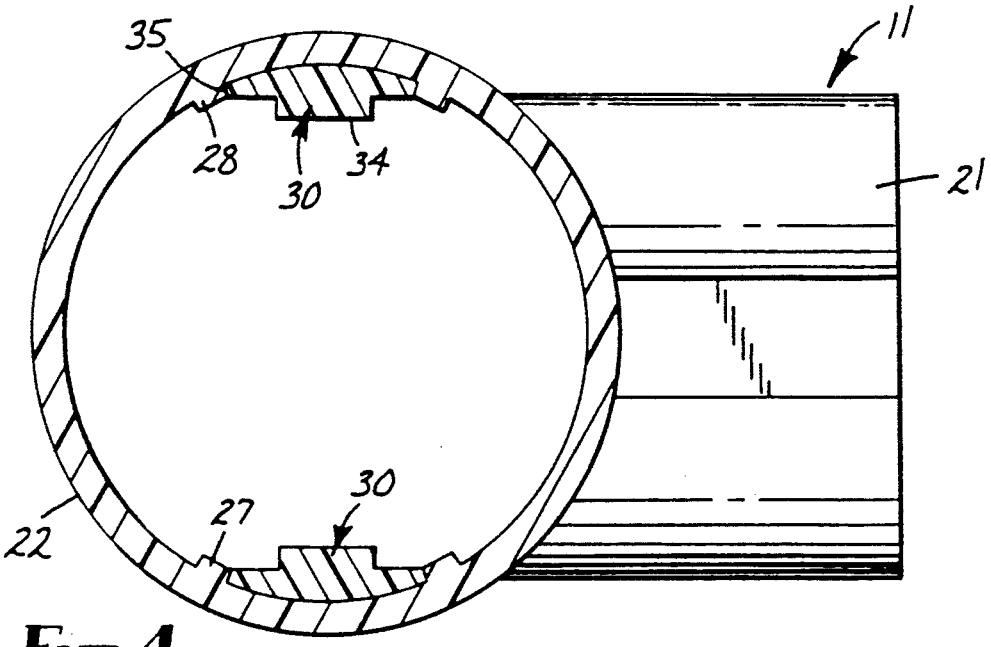
FIG. 4 is a horizontal sectional view of the connector of the present invention taken along the line 4—4 of FIG. 2.
Figure 5:
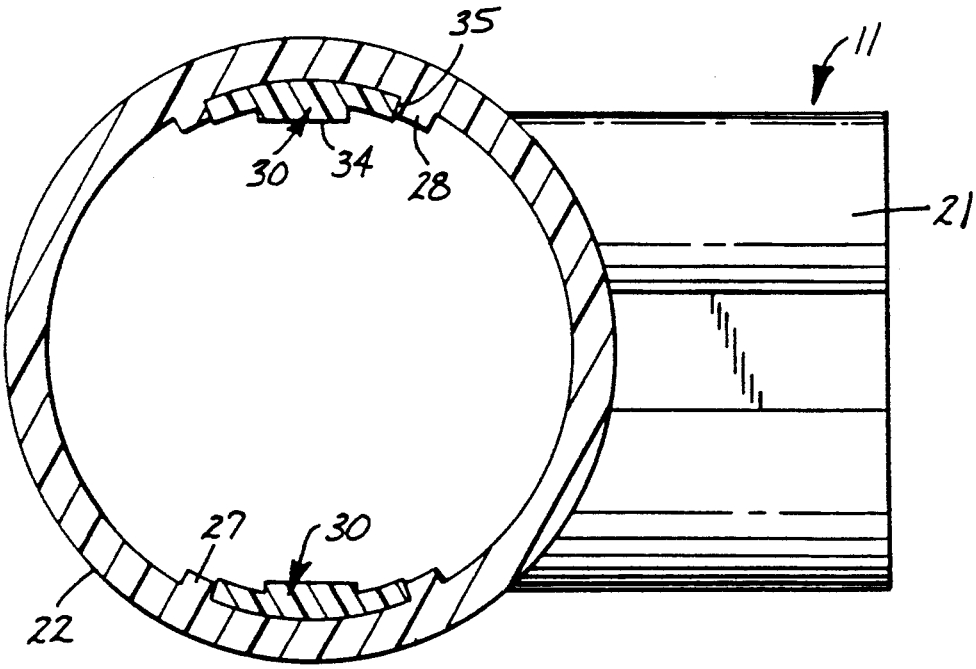
FIG. 5 is a horizontal sectional view taken along the line 5—5 of FIG. 2.
Figure 6:
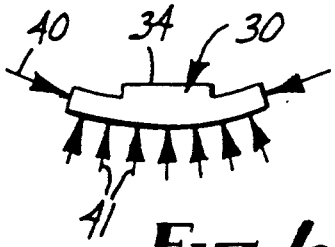
FIG. 6 is a detail view diagrammatically illustrating the forces applied against a leg member when removal forces are applied thereto.

As is best illustrated in FIGS. 4 and 5, the legs 30 are disposed between the radially inwardly directed pairs of radially disposed wall portions 27 and 28. The legs are formed with diverging side edges 35 which engage opposed inner surfaces of the wall portions 27 or 28. With the legs 30 in position between the wall portions the legs become tightly wedged between the wall portions when a force tending to lift the cap 12 is applied to the cap, or a force that would tend to rock the cap and dislodge it from the base member 11 is applied. Thus the formation of the wall portions 27 and 28, which taper or converge toward the opening to the cavity due to the conical shape of the wall members forming the cavity, and the diverging relationship of the sides of the legs 30, form a self energizing wedge-like retaining means for retaining the cap on the base member. A force tending to lift or dislodge the cap, causes forces tending to compress the leg and thus they restrict the cap from separating. As illustrated in FIG. 6, when a force is applied to lift the leg in relationship to the base 11, the resistance forces on the leg illustrated by the arrows 40 act to compress the leg. These compressive forces drive the leg outer surface against the concave inner surface of the wall members defining the cavity 25. Such forces cause increased resistance forces, identified by the arrows 41, against the convex surface of the leg which provide sufficient frictional resistance to restrict the leg or legs, and thus restrict the cap 12, from becoming dislodged from the open position on the base 11 prior to it being driven into the cavity by forces being applied to the top or end wall 31.

Figure 2:
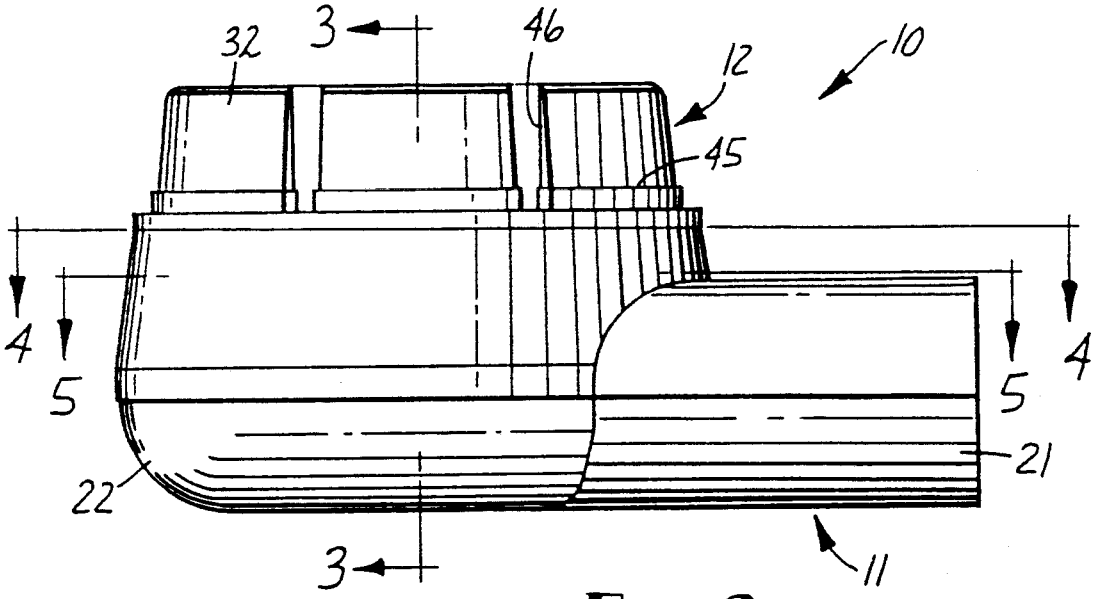
FIG. 2 is a side elevational view of the connector with the cap and base member in the assembled open position or non-connecting position.

Referring to FIGS. 4 and 5, the radially extending wall portions extend from the inner surfaces of the wall members of the base about 0.16 inch (4 mm) to their outer edges. The length of the arc between the wall portions 27 or 28 in the area of the section line 4—4 of FIG. 2 is about 0.162 inch (4.1 mm) and the length of the arc between the wall portions in the area of section line 5—5 of FIG. 2, as shown in FIG. 5, is 0.165 inch (4.2 mm). The legs of the cap 12 have substantially the same length of arc in the same areas as illustrated to fit within the space between the spaced pairs of wall portions 27 and 28. This illustrates that the wedging action is present in a direction opposite to the direction of movement of the cap when the cap is moved to a closed position. The fact that the opposite side edges 35 of the legs 30 engage the opposed surfaces of the wall portions, with the cap placed in the open and ready position, further restricts the cap from rocking on the body portion 22 when subjected to some excessive force or when the closing force is slightly off center.

The cap 12 has an outer raised circumferential or peripheral ring or rib 45 above a beveled surface on the free edges of the side walls 32. Also, recesses 46 are formed at spaced locations about the outer surface of the walls 32 to receive the wall portions 27 and 28 when the cap 12 is forced into the cavity 25 such that the cavity is well sealed when the cap is in the closed or wire connecting position.

The connecting member 13 is formed of electrically conductive ductile metal, about 0.02 inch (0.5 mm) thick, such as a copper alloy, e.g. 260 cartridge brass. The hardness is preferably ¾ hard or H03. The connecting member 13 is supported within the cap 12 and is retained therein by two oppositely projecting barbs, disposed at each end of thin plates 23 forming the legs of the U-shaped connecting member 13. The plates 23 are parallel and spaced about 0.074 inch (1.88 mm) apart. The barbs engage the legs 30. Each of the plates 23 is provided with a deep wire receiving slot 50 positioned in aligned relationship 0.317 with a wire supporting channel 24. The slots 50 are spaced 0.11 inch (2.8 mm) apart in each plate. Disposed between the wire receiving slots 50 is a clearance slot 51 which affords greater flexibility for the connecting member. The wire-receiving U-slots 50 are originally 0.0115 inch (0.29 mm)in width between the parallel portions of the opposing jaws. They are forced open to about 0.014 inch (0.36 mm) when measured through an approximate center of the deformed conductor when a 26 gauge wire is inserted into the connector. This is past the yield point of the material and the resilience of the material affords a return toward the original position to a 0.012 to a 0.0125 inch width (0.30 mm to a 0.32 mm). A 19 gauge wire forces the slot open to about 0.025 inch (0.63 mm). This is also past the yield point. The slot width relaxes to about 0.023 inch (0.58 mm) when the wire is removed. Therefore, even with the material being stressed beyond the yield point there is a continuous resilient force on the wire to maintain good electrical contact due to the elastic deformation of the material forming the connecting member 13.

The geometry of the connecting member 13 allows the plastic deformation without fracturing the connecting member. This is accomplished by the presence of the clearance slot 51 disposed between the wire receiving slots 50. Since the parallel walls of the slots 50 are forced apart as a conductor enters the flared entrance thereto the wire pushes the narrow band of material on one side of the U-slot 50 toward the center of the plate which forces the clearance slot 51 to close at the entrance and forces the material on the other side of the U-shaped slot toward the end of the plate. There is approximately equal movement on each side of the wire. Further, the tendency of the connecting element to fracture when undergoing any plastic deformation is reduced by placing a radius at the bottom of the slot which is somewhat larger than 1.5 times the width of the slot to afford reduced stress concentration without loss of effectiveness in making good electrical contact.

The deflection of the material of the plates 23 from the slots 50 toward the ends serves to urge the legs 30 of the cap 12 firmly against the inner surface of the walls forming the cavity 25 when in wire connecting position. Further, the raised rib 45 is forced tightly against the cavity walls and the sharp edge on the side of the rib near the end wall 31 will resist forces tending to dislodge the cap 12. Therefore, as the cap 12 is inserted into the base 11, the making of the junction with the conductor 16 of the wires also improves the mechanical fastening of the cap to the base. This occurs by the plates 23 of the connecting member 13 expanding at their free edge forcing the legs 30 of the cap and the side walls 32 outwardly against the walls of the base portion 22. As the walls of the base return or relax to the normal unstretched position after the cap is moved into the closed position, the walls of the cavity have again a negative angle to hold the cap.

Effective encapsulation of the wire connections to restrict the subsequent entry of water is obtained by soft plastic materials, usually of grease like consistency such as polyisobutylene, silicone greases, or a sealant sold by Minnesota Mining and Manufacturing Company, St. Paul, Minn., the assignee of this application, which encapsulant comprises polybutene synthetic rubber, mineral oil, amorphous silica and an antioxidant. The encapsulant completely fills all interstices within the connector and preferably fills the tubular wire receiving passages when a wire connection is made.

Having thus described the present invention with reference to the preferred embodiment, it will be appreciated that further modifications may be made without departing from the spirit of the invention as defined in the appended claims.

We claim:

1. A wire connector for connecting multiple wires comprising;

a base member having a plurality of side-by-side elongate wire-receiving channels having extended surfaces to support a corresponding plurality of wires, said base member and said extended surfaces being formed with at least one groove which extends across said extended surfaces and generally perpendicular to said channels, wall members defining a cavity about said extended surfaces which cavity has an opening spaced from said extended surfaces, said wall members having inner and outer surfaces, said wall members having at least two pair of spaced wall portions, said wall portions extending from said inner surface of said wall members into said cavity and being positioned in relationship to each other to diverge from said opening toward said extended surfaces, a resilient conductive connecting member comprising a plate which is deeply grooved and adapted to fit within the groove in said base member with a groove in the plate in line with each of said channels, and a cap supporting said connecting member and shaped to fit in said cavity, said cap comprising an end wall and depending side walls having two legs extending beyond the free edges of said side walls at opposed locations, said connecting member being positioned within said side walls against the interior surface of said end wall, each of said legs being disposed inside said cavity with one leg disposed between each pair of said wall portions, said legs each having side edges which diverge toward the free edge of the legs to fit between and engage opposed sides of said wall portions, whereby when a force is applied tending to separate the cap from the base the force of said legs against said wall portions tend to compress said legs and separate said wall portions to resist said separation and whereby and when sufficient force is applied against said end wall of the cap forcing it in a direction toward said base, said opening in the base member will be forced to expand allowing entry of said cap and connecting member into said cavity such that said connector affords fully effective spring reserve contact with wires disposed in said channels.

2. A wire connector according to claim 1 wherein said cap has an external peripheral rib on said side walls the peripheral dimensions of which exceed the inner peripheral dimensions of said peripheral edge of said opening of said base to restrict movement of said cap from closed position to open position.

3. A wire connector according to claim 1 wherein said base is formed of a translucent, solvent resistant hydrophobic, resilient polymeric material.

4. A wire connector according to claim 3 wherein said polymeric material is a polyolefin.

5. A wire connector according to claim 4 wherein said polyolefin is a polypropylene.

6. A wire connector according to claim 5 wherein said wall portions of said wall member diverge from said opening toward said extended surfaces, and said cap has an external peripheral rib on said side walls, the peripheral dimensions of which exceed the inner peripheral dimensions of said peripheral edge of said opening of said base member to restrict movement of said cap from closed position to open position.

7. A wire connector according to claim 1 wherein said connecting member is formed of about 0.5 mm thick conductive metal.

8. A wire connector according to claim 7 wherein said metal is a ductile copper alloy of three quarters hardness.

9. A wire connector according to claim 7 wherein said connecting member is a U-shaped member comprising a pair of plates spaced 1.88 mm apart.

10. A wire connector according to claim 7 wherein said base member is formed of flexible polypropylene.

11. A wire connector for connecting multiple wires comprising;

a base member having a plurality of side-by-side elongate wire-receiving channels having extended surfaces to support a corresponding plurality of wires, said base member being formed with parallel grooves across said extended surfaces and generally perpendicular to said channels, wall members defining a generally truncated conical cavity about said extended surfaces, said wall members having inner and outer surfaces, the axis of which extends general perpendicular to the axes of said wire receiving channels, with the wall members defining said cavity diverging from an opening into said cavity toward said extended surfaces, and said wall members having circumferentially spaced radially directed wall portions positioned one pair adjacent each end of said pair of grooves, a U-shaped resilient conductive connecting member, the legs of the U being wide thin closely spaced and deeply grooved plates adapted to fit within the parallel grooves and with a groove in each plate in line with each of said channels, and a cap supporting said connecting member and shaped to fit in said cavity, said cap comprising an end wall and depending side walls having two legs extending beyond the free edges of said side walls at peripherally spaced locations, said connecting member being positioned between said legs, the dimensions of said free edges of said depending side walls of said cap being slightly greater than the inside dimension of the opening in said base member, each of said legs being disposed inside said cavity with one leg disposed between each pair of said wall portions at the ends of said grooves, and said legs each having side edges which diverge toward the free edge of the legs to fit between and engage opposed surfaces of said wall portions, whereby when a force tending to separate the cap from the base is applied the force of said side edges of said legs against said wall portions and the force against the inner surface of said wall members increases to resist separation, and whereby when sufficient force is applied against said end wall of the cap forcing it in a direction toward said base member, said opening in the base member will be forced to expand allowing entry of said cap and connecting member into said cavity such that said connector affords fully effective spring reserve contact with the wires disposed in said channels.

12. A wire connector according to claim 11 wherein said cap has recess means in the side walls for receiving said wall portions when said cap is forced into said cavity of said base member.

13. A wire connector according to claim 11 wherein said base member has an encapsulant such as a soft plastic material with grease-like consistency in the cavity to encapsulate the wire connections.

14. A wire connector according to claim 11 wherein said plates are spaced 1.88 mm apart.

15. A wire connector according to claim 11 wherein said base is formed of a translucent, solvent resistant, hydrophobic, resilient polymeric material.

16. A wire connector according to claim 15 wherein said polymeric material is a polyolefin.

* * * * *